United States Patent [19]

Minks

[11] Patent Number: 4,827,232

[45] Date of Patent: May 2, 1989

[54] RELAY, PARTICULARLY MINIATURE RELAY

[75] Inventor: Werner Minks, Heroldsberg, Fed. Rep. of Germany

[73] Assignee: Alcatel N.V., Amsterdam, Netherlands

[21] Appl. No.: 93,843

[22] Filed: Sep. 8, 1987

[30] Foreign Application Priority Data

Sep. 6, 1986 [DE] Fed. Rep. of Germany ..... 3630467

[51] Int. Cl.[4] ..... H01H 51/22

[52] U.S. Cl. ..... 335/78; 335/128; 335/85

[58] Field of Search ..... 335/78–84, 335/121, 124, 128, 129, 202, 281, 85

[56] References Cited

U.S. PATENT DOCUMENTS

| | | | |
|---|---|---|---|
| 3,130,284 | 4/1964 | Woods | 335/202 |
| 3,172,975 | 3/1965 | Williams | 335/81 |
| 4,602,230 | 7/1986 | Schedele | 335/81 |

FOREIGN PATENT DOCUMENTS

| | | |
|---|---|---|
| 0127849 | 12/1984 | European Pat. Off. . |
| 0198594 | 10/1986 | European Pat. Off. . |
| 1514717 | 6/1969 | Fed. Rep. of Germany . |
| 2614943 | 10/1977 | Fed. Rep. of Germany . |
| 2448053 | 9/1979 | Fed. Rep. of Germany . |
| 2808207 | 1/1980 | Fed. Rep. of Germany . |

*Primary Examiner*—C. L. Albritton
*Assistant Examiner*—Lincoln Donovan
*Attorney, Agent, or Firm*—Spencer & Frank

[57] ABSTRACT

A relay, particularly a miniature relay, comprising a mounting base of insulating material having the contact system and the magnet system attached thereto a slip-on cover extends to the bottom of the mounting base, through which the coil and contact terminals are brought out. The core of the magnet system is disposed in the direction of the longitudinal axis of the cover. Accordingly a coil form is integrally formed on the mounting base on a side opposite the bottom (3) of the mounting base (2), and between the mounting base and an internal flange of the coil form there is a hollow portion which is open on at least one side and in which the pole piece is inserted.

8 Claims, 2 Drawing Sheets

RELAY, PARTICULARLY MINIATURE RELAY

BACKGROUND OF THE INVENTION

Field of the Invention

The present invention relates to a relay, particularly a miniature relay, wherein a mounting base of insulating material has a contact system and a magnet system attached thereto. A slip-on cover extends to the bottom of the mounting base, through which a coil and contact terminals are brought out. The core of the magnet system is disposed in a direction of the longitudinal axis of the slip-on cover.

A similar relay is disclosed in EP-A-No. 0 127 849. There, the terminals of the fixed contacts and of the moving contacts are firmly moulded in the mounting base. This necessitates a relatively costly and complicated injection-molding process. The contact system is disposed beside the magnet system and driven via an angle armature one free leg of which is pivotable against the end face of the core of the magnet system, and the other free leg of which extends parallel to the yoke and can actuate the moving contact.

SUMMARY OF THE INVENTION

The object of the present invention is to design a relay in such a way that it is easy to assemble and that the necessary component parts are easy to manufacture.

This object is attained by the features set forth in a relay with a mounting base of insulating material having a contact system and a magnet system attached thereto. A slip-on cover extends to the bottom of the mounting base, through which a coil and contact terminals are brought out. The core of the magnet system is disposed in a direction of the longitudinal axis of the slip-on cover. As a result, only a single part of insulating material is required which consists of the mounting and the coil form integrally formed on the base, and which also serves to mount the magnet system. The insulating part is so designed that all parts to be mounted can be inserted from above.

BRIEF DESCRIPTION OF THE DRAWINGS

An embodiment of the invention will now be described with reference to the accompanying drawings, in which.

DESCRIPTION OF THE PREFERRED EMBODIMENT

Figure 1:
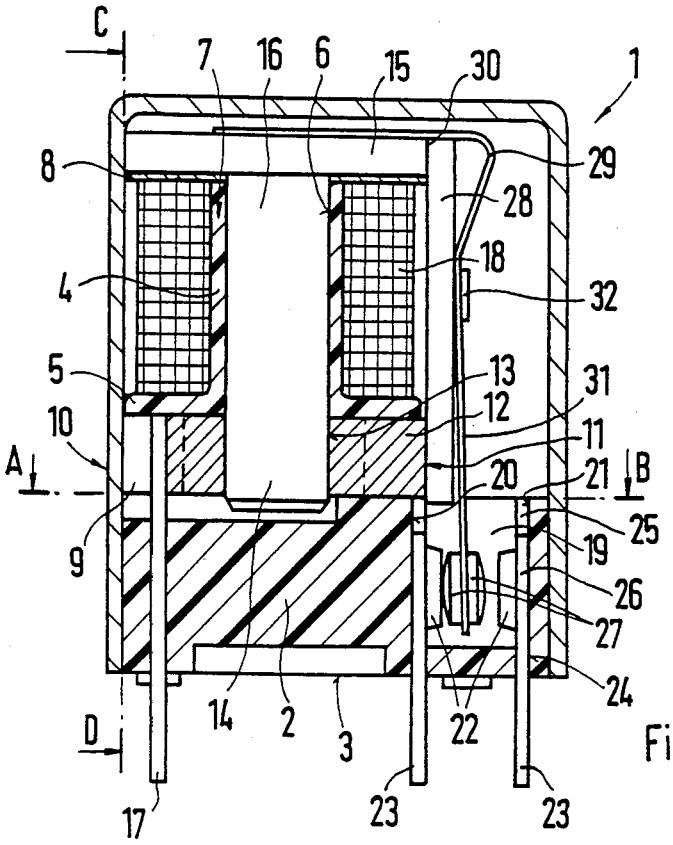
FIG. 1 is a sectional side view of the relay in the operated condition.
Figure 2:
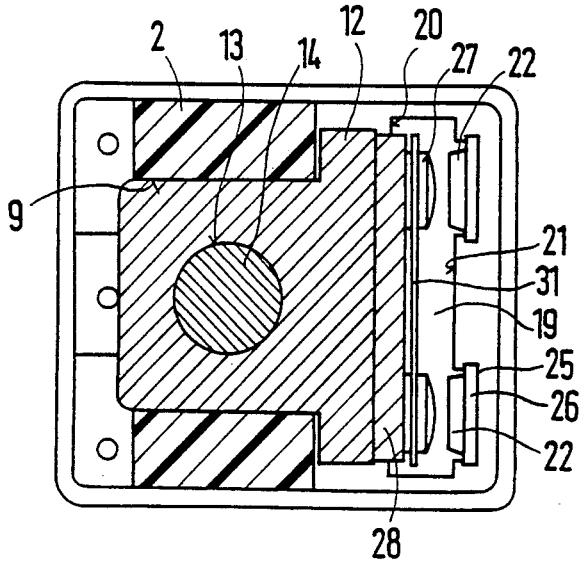
FIG. 2 is a section taken along line A–B of FIG. 1.
Figure 3:
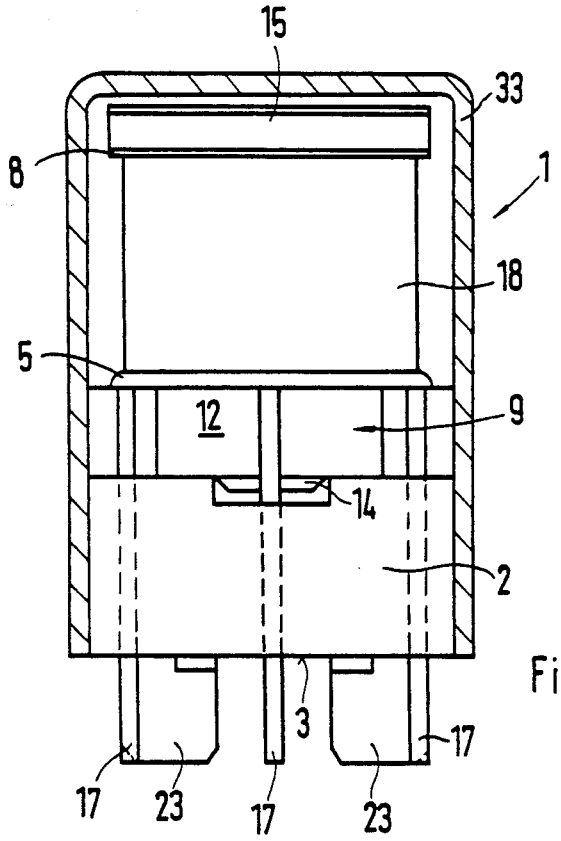
FIG. 3 is a section taken along line C–D of FIG. 1.

The relay 1 comprises a mounting base 2 of insulating material having a coil form 4 integrally formed therewith on the side opposite the bottom 3. The coil form 4 has an internal flange 5 and a winding mandrel 7 with a hole 6. It may also have an integral external flange; in the embodiment shown, however, this external flange is formed by a disk 8 of insulating material.

Between the internal flange 5 and the mounting base 2, there is a hollow portion 9 which is open either on one side 10 or on two sides 10 and 11. Into this hollow portion 9, a pole piece 12 is insertable from the side 10 or from either of the sides 10 and 11.

The pole piece 12 has a hole 13 into which the end 14 of a core 16 provided with a flange 15 and forming part of the magnet system is pressed when being passed through the hole 6 of the winding mandrel 7 and pushed in the direction of the bottom 3. As the core 16 is inserted, the disk 8, which was previously slipped over the core 16, is fixed in position.

Below the core end 14, a flat groove 9' may be provided in the hollow portion 9, so that, when the core end 14 is being pressed into the hole 13 of the pole piece 12, two lateral bearing surfaces are formed which permit the core end to be pushed through the hole 13 by a small measure. The flange 15 and the core 16 are preferably made as a single upset or pressed apart of suitable magnetic material.

Inserted or moulded in the mounting base 2 are one or more, preferably straight, terminals 17 for the coil 18.

Below the recess 9, directly beside the coil form 4, there is a bowl-like recess 19, at whose long sides 20 and 21, which are parallel to a tangent to the coil form 4, the fixed contacts 22 are disposed by passing their terminals 23 through associated holes 24 in the bottom 3. To secure the fixed contacts 22 in position, guide grooves 25 adapted to the cross sections of the fixed-contact supports 26 are formed in the long sides 20, 21 in the direction of the longitudinal axis of the coil. The contact supports 26 can be inserted into these guide grooves 25 from above. The contact planes of the fixed contacts 22 are thus parallel to the tangent to the coil form 4 and parallel to the longitudinal axis of the coil form.

The moving contacts 27 of the contact system(s) 22, 27 project into the recess 19. The moving contacts(s) 27 is (are) attached to a clapper armature 28 constituted by a straight strip section and forming part of the magnet system 12, 15, 16, 28. As can be seen, no bent parts are required for the magnet system. The clapper armature 28 is fastened to the flange 15 by means of an angle spring 29, so that a fulcrum for the clapper armature 28 is obtained at the upper edge 30. The angle spring 29 also supports the moving contacts 27. It has a tongue 31 via which the moving contacts 27 are resiliently mounted on the clapper armature 28. The angle spring 29 is attached to the clapper armature 28 by means of a boss 32 on the armature 28, which is used as a rivet.

The assembly is closed by a slip-on cover 31. The latter may be joined to the mounting base with adhesive or sealed wash-tight by applying a suitable sealing compound, such as cast resin, to the bottom 3.

I claim:

1. A relay including a mounting base of insulating material having a contact system and a magnet system attached thereto, and a slip-on cover extending to a bottom of said mounting base, through which a coil and contact terminals are brought out, a core of said magnet system being disposed in a direction of a longitudinal axis of said slip-on cover, comprising a coil form integrally formed on the top of said mounting base, said coil form having an internal flange for forming on at least one side of said mounting base, a hollow portion, a pole piece inserted into said hollow portion and having a hole for pressing an end of a core into, said core inserted into a winding mandrel of said coil form and said core having a flange permanently connected therewith, a clapper armature located on said mounting base, said clapper armature movably attached to said flange of said core by means of an angle spring, and said angle spring attached to said clapper armature and said flange for supporting said contact system.

2. A relay as claimed in claim 1, wherein said mounting base has a bowl-like recess positioned beside said coil form for supporting said contact system and said contact system having fixed contacts, said fixed contacts having terminals extending through said bottom of said mounting base with contact planes lying parallel to a tangent of said coil form and parallel to an axis of said coil form.

3. A relay as claimed in claim 2, wherein said bowl-like recess includes guide grooves for securing supports of said fixed contacts in position.

4. A relay as claimed in claim 2, wherein said contact system includes two fixed contacts provided at opposite side walls of said recess, and said contact system has at least one moving contact extending into a space between said two fixed contacts.

5. A relay as claimed in claim 4, wherein said moving contact is attached to a spring tongue, and said spring tongue is deflatably mounted on said clapper armature.

6. A relay as claimed in claim 4, wherein said spring tongue and said angle spring form a single homogeneous component.

7. A relay as claimed in claim 1, wherein said coil form has an internal flange, and said flange of said core is formed by a disk of insulating material placed on said winding mandrel and held in place by said magnet system.

8. An assembling method for manufacturing a relay including a mounting base of insulating material having a contact system and a magnet system attached thereto, and a slip-on cover extending to a bottom of said mounting base, through which a coil and contact terminals are brought out, a core of said magnet system being disposed in a direction of a longitudinal axis of said slip-on cover, comprising a coil form integrally formed on the top of said mounting base, said coil form having an internal flange for forming on at least one side of said mounting base a hollow portion, wherein terminals of said coil form and fixed contacts of said contact system are inserted into said mounting base, a pole piece is inserted into said hollow portion from one side of said mounting base, a disk is slipped over said core and said core has a flange with said core being passed through a hole in a winding mandrel and an end of said core is pressed into a hole of said pole piece, a coil is wound onto said coil form for making contact thereto, a clapper armature is inserted for forming part of said magnet system, an angle spring having a free leg is secured to said flange in a position determined by said contact system, and said slip-on cover is slipped on and sealed to form said relay.

* * * * *